United States Patent [19]

Toyoda

[11] 4,372,207

[45] Feb. 8, 1983

[54] INK FOUNTAIN DEVICES FOR USE IN PRINTING PRESS

[75] Inventor: Hideaki Toyoda, Tokyo, Japan

[73] Assignee: Komori Printing Machinery Co., Ltd., Japan

[21] Appl. No.: 307,854

[22] Filed: Oct. 2, 1981

[30] Foreign Application Priority Data

Mar. 10, 1981 [JP] Japan ..... 56-34304
Mar. 10, 1981 [JP] Japan ..... 56-34305

[51] Int. Cl.[3] ..... B41F 31/04; B41F 31/06
[52] U.S. Cl. ..... 101/365
[58] Field of Search ..... 101/365, 157, 169; 118/261; 15/256.5, 256.51

[56] References Cited

U.S. PATENT DOCUMENTS 1,574,474 2/1926 Faltus ..... 101/365
3,521,561 7/1970 Pali et al. ..... 101/169
4,000,694 1/1977 Schruder ..... 101/365
4,058,058 11/1977 Hantscho ..... 101/365

FOREIGN PATENT DOCUMENTS 1437974 6/1976 United Kingdom ..... 101/365

*Primary Examiner*—J. Reed Fisher
*Attorney, Agent, or Firm*—Thompson, Birch, Gauthier & Samuels

[57] ABSTRACT

In a ink fountain device for use in a printing press of the type wherein an ink fountain roller is dipped in an ink pot and a quantity of ink supplied to the printing press is controlled by varying a gap between the ink fountain roller and a blade, the blade is divided into a plurality of sections along the length of the ink fountain roller. Each divided blade is normally urged by a spring to move away from the ink fountain roller and further urged toward the same by another spring and an adjusting screw through a roller urged against a rear end of the divided blade. In this manner, respective blades can be independently adjusted so as to adjust the thickness of ink film along the length of the fountain roller, to be commensurate with a tone or contrast of a printed matter.

6 Claims, 11 Drawing Figures

INK FOUNTAIN DEVICES FOR USE IN PRINTING PRESS

BACKGROUND OF THE INVENTION

This invention relates to an ink fountain device for continuously supplying printing ink of a predetermined quantity to a printing press.

An ink fountain for supplying printing ink to a platen mounted on a platen roller of a rotary printing press generally comprises an ink fountain device for dispensing the ink stored in an ink pot at a predetermined rate and a plurality of groups of rollers which transfer the dispensed ink to the surface of the platen and makes uniform the thickness of the ink film transferred to the platen. The ink fountain device has been constructred as shown in FIG. 1 where beneath a fountain roller 1 which is rotated in the direction of arrow A are provided stays 2 and 3 having substantially the same length as the longitudinal length of the roller 1, with an inclined blade support 4 having the same length as the stay 2 is mounted thereon by bolts 5. A fountain blade 6 made of a thin steel plate and having the same length as the blade support 4 is bolted onto the upper surface thereof with its inner end closely adjacent to the periphery of the fountain roller 1, and vertical triangular side plates 7 are secured to the opposite sides of the blade support 4. A plurality of L shaped adjusting pieces 8 are pivotally mounted on the top of the other stay 3 with equal spacings of 20 to 50 mm, for example, respective adjusting pieces 8 being adjusted by corresponding adjusting screws 9. The printing ink 10 is stored in an ink pot defined by the fountain roller 1, the fountain blade 6 and both side plates 7. As the fountain roller 1 rotates, the ink 10 flows out through a gap between the fountain roller 1 and the fountain blade 6 so as to form a thin ink film on the surface of the fountain roller 1. The thickness of this ink film, that is the quantity of the ink supplied to the platen is adjusted by adjusting the adjusting screws 9 so as to elastically deform the fountain blade 6 for adjusting the gap between the tip of the fountain blade 6 and the periphery of the fountain roller 1. The quantity of the ink can be individually adjusted in respective sections of the fountain roller 1 obtained by dividing the same in the axial direction, by independently adjusting the adjusting screws 9 thereby adjusting the quantity of the ink in accordance with the contrast of printed matters.

However, in the prior art ink fountain device of the type described above, the fountain blade 6 is constructed as a single blade. Thus where it is desired to decrease the quantity of the ink at portions corresponding to adjusting scres 9A and 9B on both sides and to increase the quantity of ink at an intermediate portion corresponding to an intermediate adjusting screw 9C as shown in FIG. 2, even when the intermediate adjusting screw 9C is retracted while the adjusting screws 9A and 9B are maintained in their advanced states, the fountain blade 6 would maintain its state determined by the adjusting screws 9A and 9B on both sides and responds to the retraction of the adjusting screw 9C. Accordingly, it has been necessary to retract the adjusting screws 9A and 9B slightly on both sides, which results in a rough adjustment as shown in FIG. 3. Moreover, advance of a single adjusting screw has an influence on both sides thereof thus comprising the accuracy of adjustment.

To obviate these problems it has been proposed to use a divided fountain blade system in which the fountain blade is divided into a plurality of sections in the axial direction of the fountain roller 1. However in such divided fountain blade systems, it is necessary to vary the thickness of the ink film for respective blade sections and moreover it is necessary not only to adjust the sections at high accuracies but also to be able to adjust the sections from a remote position. Moreover since it is necessary to frequently dismount the divided sections for maintainence, washing and color change, it is necessary to separately prepare the blade sections and their adjusting mechanisms and then assemble them. However, prior art divided fountain blade systems cannot satisfy these requirements so that it has been highly desired to develope and improved ink fountain device.

SUMMARY OF THE INVENTION

Accordingly, it is an object of this invention to provide an improved ink fountain device for a printing press capable of accurately adjusting the quantity or thickness of ink films at respective sections along the length of the ink fountain roller.

Another object of this invention is to provide an improved ink fountain device of the type just described, in which the divided blades can be readily removed independently of their adjusting mechanism for inspection, washing and color change.

Still another object of this invention is to provide an inke fountain device of the type just described, in which there is no backlash between the divided and their adjusting mechanism so that the thicknesses of the ink film at respective sections can be accurately and quickly controlled.

A further object of this invention is to provide an ink fountain device of the type described above that does not require any readjustment when the removed divided blades are reassembled.

According to this invention there is provided an ink fountain device for use in a printing press of the type comprising an ink fountain roller dipped in an ink pot, a blade support, a plurality of divided blades juxtaposed on the blade support to be movable toward and away from the periphery of the ink fountain roller, characterized in that there are provided support to be movable toward and away from the periphery of the ink fountain roller, characterized in that there are provided first spring means for urging the divided blades to move away from the ink fountain roller, a plurality of brackets secured to the blade support, a plurality of adjusting levers respectively pivotally mounted on the brackets, a plurality of rollers supported by the brackets with their peripheries engaged with the rear ends of respective divided blades, a plurality of sliding members supported by the blade support to reciprocate in the same directions as the divided blades and respectively provided with screw threads, means for operatively connecting the adjusting levers with respective sliding members, a plurality of adjusting screws respectively mating with the screw threads of the sliding members and second spring means for urging the sliding members to cause to swing the adjusting levers so as to cause the rollers to move the divided blades toward the ink fountain roller.

According to one embodiment of this invention the upper end of each adjusting lever is connected to one end of one of the brackets through a pin having an eccentric portion, and each roller takes the form of an annular ring surrounding the eccentric portion. According to the modified embodiment, the upper end of each adjusting lever is pivotally connected to the bracket and a roller is supported by an offset portion of the upper end of the adjusting lever to engage the rear end of each divided blade.

BRIEF DESCRIPTION OF THE DRAWINGS

In the accompanying drawings.

Throughout the drawings corresponding elements are designated by the same reference numerals.

DESCRIPTION OF THE PREFERRED EMBODIMENTS

Figure 1:
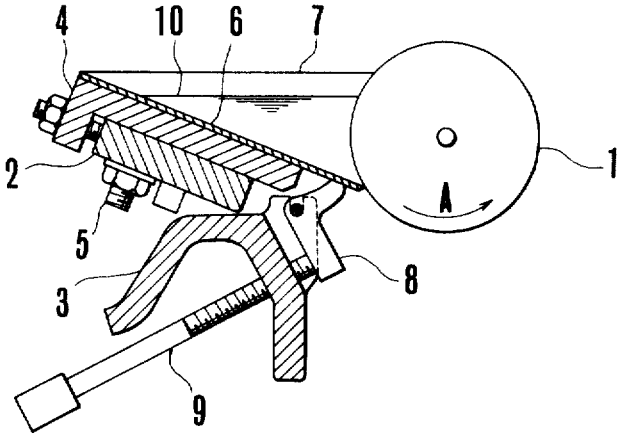
FIG.1 PRIOR ART
FIG. 1 is a side view showing a prior art ink fountain device.
Figure 2:
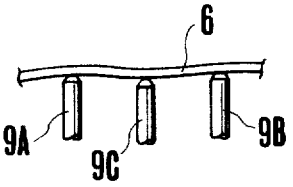
FIG.2 PRIOR ART
FIGS. 2 and 3 are partial side views of the prior art device for explaining methods of adjusting the quantity of printing ink.

Referring to FIGS. 4 through 7 showing a preferred embodiment of this invention, the ink fountain device 11 shown therein comprises an ink fountain roller 12 rotated in a direction of an arrow C and supported by a machine frame, not shown, and a supporting shaft 13 with its both ends journaled by the machine frame at the right lower position with reference to the ink fountain roller 12. An inclined blade support 14 having substantially the same length as the roller 12 is securely mounted on the supporting shaft 13 with the forward edge positioned at a lower position. A square stay 15 having a square cross-section and substantially the same length as the blade support 14 is secured to the upper rear end of the blade support 14 with both ends supported by shoulders at both ends of the blade support 14 and a small stay 16 having the same length as the square stay 15 is secured to the bottom surface thereof with bolts 18 (see FIG. 5).

To a main body of the ink fountain device 11 constituted by the blade support 14, the square stay 15 and the small stay 16 are secured a plurality of divided fountain blade sections 19 and gap adjusting mechanisms of the same number as the blade sections. More particularly, each divided blade section 19 is formed as an elongated rectangular shape and slidably mounted on the finished upper surface of the blade support 14 to be movable toward and away from the ink fountain roller 12 with the side edges in contact with adjacent sections. The divided blade sections 19 are urged to contact each other by adjustable spring means, not shown, provided on both sides of the blade section assembly. Each divided section 19 is formed with a perforation 20 for receiving the head of an eccentric pin 21 rotatably inserted into an opening formed on the upper surface of the blade support 14. The top surface of the pin 21 is provided with a screw driver engaging groove, and a pin shaped spring receiver 22 is secured to the top of the pin 21 at a position eccentric to the axis of the eccentric pin 21. A compression spring 24 is received in a spring groove 23 provided at the rear end of a divided blade 19 in communication with the perforation 20 between the spring receiver 22 and the rear wall 25 of the spring groove 23, so that when the eccentric pin 21 is rotated 180° the spring 24 is compressed or released between the spring receiver 22 and the rear wall 25. When the spring receiver is urged by the spring 24, the divided blade 19 is moved along the blade support 14 away from the fountain roller 12 via the eccentric pin 21, whereas when the spring receiver 22 is released from the force of the spring it becomes possible to remove the divided blade 19 away from the blade support 14. A click mechanisms comprising a ball 26 and a compression spring 27 is provided for the eccentric pin 21 for holding the same at positions where it is urged by or released from the force of the spring 23.

A clamping plate 28 made of a thin steel sheet having a length substantially the same length as the overall length of the divided blades 19 which are held in a manner described above is superposed on the upper surfaces of the divided blades 19, and the rear end of the clamping plate 18 is secured to the upper shoulder of the square stay 15. Each divided blade section 19 is provided with permanent magnets 29 and 30 arranged in the longitudinal direction of the blade 19 for attracting the clamping plate 28 against the divided blades 19 and for attracting the same against the blade support 14.

Figure 7:
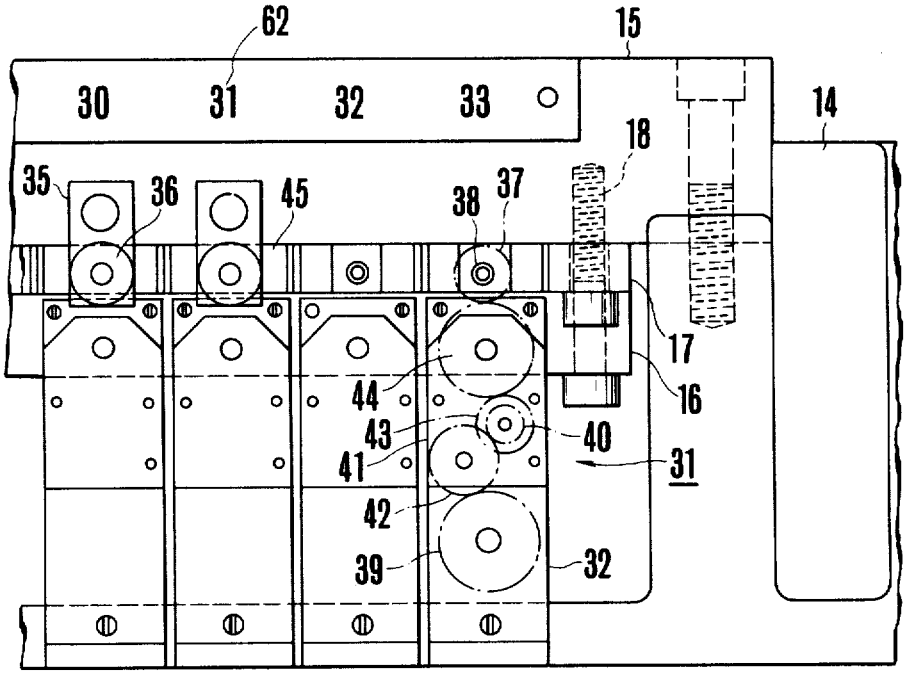
FIG. 7 is a side view of the device shown in FIG. 5 as viewed in the direction of an arrow B.

A gap adjusting mechanism provided for each divided blade 19 will now be described. More particularly, between the small stay 16 and the lower rear end of the blade support 14 are provided a plurality of sets of the gap adjusting unit, generally designated by a reference numeral 31, for respective divided blades. Each gap adjusting unit comprises an elongated base plate 32 that interconnects the small stay 16 and the rear end of the blade support 14. On the base plate 32 are mounted an electric motor 33 and a potentiometer 34 which are connected to a control panel, not shown, with their shafts protruded to the rear side of the base plate 32. An adjusting screw 38 whose axial movement is limited by a knob 36 and a gear 37 is mounted on a bracket 35 secured to the rear surface of the square stay 15. As shown in FIG. 7, a gear 39 secured to the shaft of the potentiometer 34, and a gear 40 secured to the shaft of the motor 33 are interconnected through an intermediate gear 42 on a gear shaft journalled by the base plate 32 and an outer plate 41. A gear 43 integral with the gear 40 and a gear 37 on the adjusting screw 38 are interconnected by an intermediate gear 44 on a gear shaft journalled by the base plate 32 and the outer plate 41.

Figure 8:
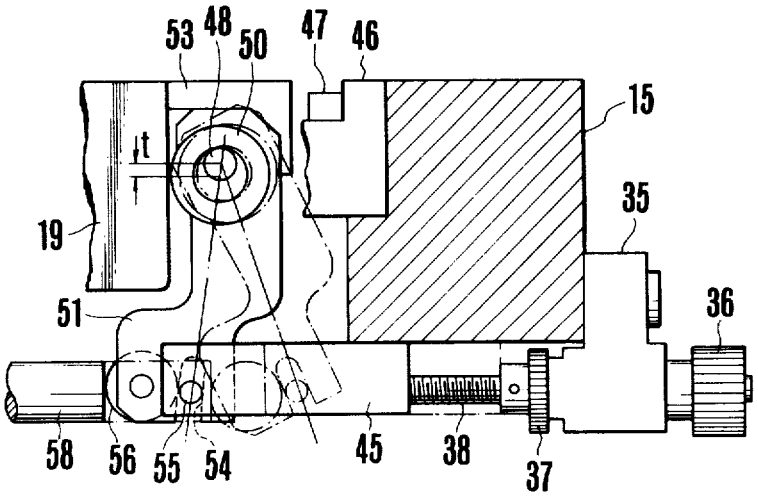
FIG. 8 is an enlarged view, partly in section, showing the ink quantity adjusting motion transmitter.

Sliding members 45 having a slightly smaller width than that of each divided blade 19 and U shaped front ends are provided between the square stay 15 and the small stay 16 to be slidable in the same directions of movements of the divided blades 19 and the aforementioned adjusting screws 28 are threaded into the threaded openings of the sliding members 45. A U-shaped bracket 46 is secured to the front surface of the square stay 15 with a bolt 47 and an opening at the forward end of the bracket 46 rotatably supports an eccentric shaft 48 through a bearing 49. As shown in FIG. 8, the central portion of the eccentric shaft 48 is made to be eccentric by t with respect to the opposite end and an annular roller 50 is rotatably mounted about the eccentric portion, with the periphery of the roller 50 engaged against the rear end of a divided blade 19. An adjusting lever 51 is mounted on a portion of the eccentric shaft 48, which is concentric with both ends. The upper end of the adjusting lever 51 is in the form of a U with both its legs positioned on the opposite sides of the roller 50. The adjusting lever 51 is secured to the eccentric shaft 48 with a set screw 52. In other words, the adjusting lever 51 is swingably supported by bracket 46 through the eccentric shaft 48. An L-shaped control member 53 made of a thin plate is secured to the rear end surface of each divided blade 19 so as to clamp the roller 50 between the control member 53 and the rear end surface of the divided blade 19, thus preventing the roller from moving in the fore and aft directions. The end of the adjusting lever 51 is formed with a slot 54 for receiving a pin 55 provided at the operating end of the control lever 51. A roller 56 is pivoted near the slot and pin engagement, and a press pin 58 slidably extending through an intermediate wall of the blade support 14 is urged against the periphery of the roller 56 by a compression spring 57 interposed between the front wall of blade support 14 and the press pin 58. This construction urges the sliding member 45 in one direction to eliminate gaps at the threaded portion.

The ink fountain device 11 operates as follows. Prior to the printing operation, the printing ink 61 is poured into the ink pot defined by fountain roller 12, divided blades 19, clamping plate 28 and side plates 60 on both side thereof. When the printing operation is commenced, and as the fountain roller 12 rotates, the ink 61 continuously flows out through the gap $t_1$, between the fountain roller 12 and the divided blades 19 to form an ink film on the peripheral surface of the fountain roller 12 and the ink film is then supplied to the platen surface of the platen roller through a plurality of roller groups.

As above described, it is necessary to adjust the quantities of the ink at respective divided sections to be commensulate with the contrast or pattern of the printed matter. The adjusting mechanism of this invention operates as follows. At the time of assembling the ink fountain device, a zero adjustment of the adjusting mechanism is made for respective divided blades. More particularly, after adjusting the gap between the gear 37 and the sliding member 45 to a predetermined size, the marking lines previously provided for the adjusting lever 51 and the eccentric shaft 48 are aligned and then the adjusting lever 51 and the eccentric shaft 48 are secured together with the set screw 52. After rotating the potentiometer 34 to a zero position, that zero position is held with one hand and the knob 36 is rotated with the other hand to rotate the adjusting lever 51 until the front ends of the divided blades engage the periphery of the ink fountain roller 12, thus accomplishing a zero adjustment. Thereafter, the operator determines the amounts of the ink at each sections with the control panel while observing a test printed matter, and then pushes the push buttons 62 corresponding to respective section numbers shown in FIG. 7. More particularly, when the push buttons are depressed, the respective motor 33 is energized to rotate the adjusting screw 38 through gears 39, 42, 40, 43, 44 and 37. Accordingly, the sliding member 45 is moved to the left or right to swing the adjusting lever 51 between solid line position and dot and dash line position by the engagement of the pin 55 and the slot 54. Consequently, due to the eccentricity of the eccentric shaft 48, the annular roller 50 displaces along a circular arc having a center at the center of the supports of the eccentric shaft 48, and as a result of this displacement the roller 50 moves toward and away from the ink fountain roller 11. As the roller 50 and the divided blade 19 moves in unison in this direction due to the engagement of the control member 53 against the divided blade 19, the blade 19 is also moved by the same amount as such movement so as to adjust the gap $t_1$, between each divided blade and the fountain roller 12, that is the quantity of ink flowing out through the gap $t_1$. The potentiometer 34 detects the rotation of the adjusting screw 38 through a gain train to generate a signal so that the operator can know the result of adjustment by viewing the control panel. Since the adjusting lever 51 and the sliding member 49 are urged by the compression spring 57, the divided blade 19 is urged by the compression spring 24 and since the roller 50 is clamped between the divided blade 19 and the control member 53, there is no backlash between these elements which enables accurate adjustment of the gap in exact proportion to the angle of rotation or number of rotations of the adjusting screw 38. Moreover, since the roller 50 directly moves the divided blade 19 toward and away from the fountain roller to adjust the gap therebetween, and since even when the adjusting lever 51 is fully rotated the point at which the roller 50 engages the divided blades would not be moved in any appreciable extent, no force will be created tending to move the divided blade 19 in the vertical direction. Morever, since the roller 50 engages the divided blade with a rolling contact no twisting force would be applied to the blade 19 thus ensuring smooth reciprocating motion thereof with no friction. As the rotational motion of the threaded shaft is converted into the swinging motion of the adjusting lever 51 after the rotational speed has been reduced through gears and the threaded shaft and since the divided blade is positively displaced by an eccentric function it is not only possible to obtain high accuracy adjustments, but also effect such adjustments with a remotely controlled motor.

It is often necessary to dismount the divided blades from the blade support 14 for maintainance, washing and color change.

To this end, in this embodiment, the clamping plate 28 is removed, a screw driver is inserted into the opening 20 of each divided plate 19 to rotate the eccentric shaft 21 180°. The spring receiver 22 thus is rotated eccentrically to release the spring force of the compression spring 24, thus facilitating the removal of the divided plates 19. In this manner, the divided blades and the adjusting mechanisms are assembled in a perfectly isolated state. Accordingly, it is possible to remove the divided blades independently of the adjusting mechanisms and the adjusted position can automatically be resumed after reassembly.

In this embodiment, since the divided blades 19 are clamped by the clamping plates 28 and permanent magnets 29 and 30 are embedded in each divided plate the clamping plate 28, the divided segments 19 and the blade support 14 are held in intimate contact so that no fear of invasion of ink into the upper and lower sliding surfaces of the divided blades 19. Thus, ink or sludge thereof deposited on these surfaces does not make sluggish the movement of the divided blades. This means smooth adjustment and elimination of extra removing operation of the ink sludge.

As above described, according to this invention, adjusting levers are pivoted to the blade support by eccentric shafts, rollers surrounding the eccentric portions of the eccentric shafts are caused to engage the rear ends of the divided blades, the sliding members with its operating ends engaged with the free ends of the adjusting levers are slid by adjusting screws for reciprocating the divided blades to adjust the gaps between the ink fountain roller and the divided blades. Moreover, as it is possible to move the divided blades toward and away from the fountain roller by directly contacting the rollers against the blades, the adjustment of the ink quantities can be made at high accuracies for respective divided blades by individually adjusting the gaps between the fountain roller and respective divided sections in accordance with the contract of the printed matter. In addition, this decreases the wear of various parts. Since the divided blades and their adjusting mechanisms are perfectly isolated, the divided blades can be dismounted independently of the adjusting mechanisms for effecting, repair washing or color change so that it is not necessary to readjust after reassembling. Moreover, since the rotational motions of the shafts are transmitted to the divided blades through gears, screws and eccentric shafts it is possible not only to drive the shafts with electric motors but also to detects rotations thereof which is suitable for remote control.

Figure 9:
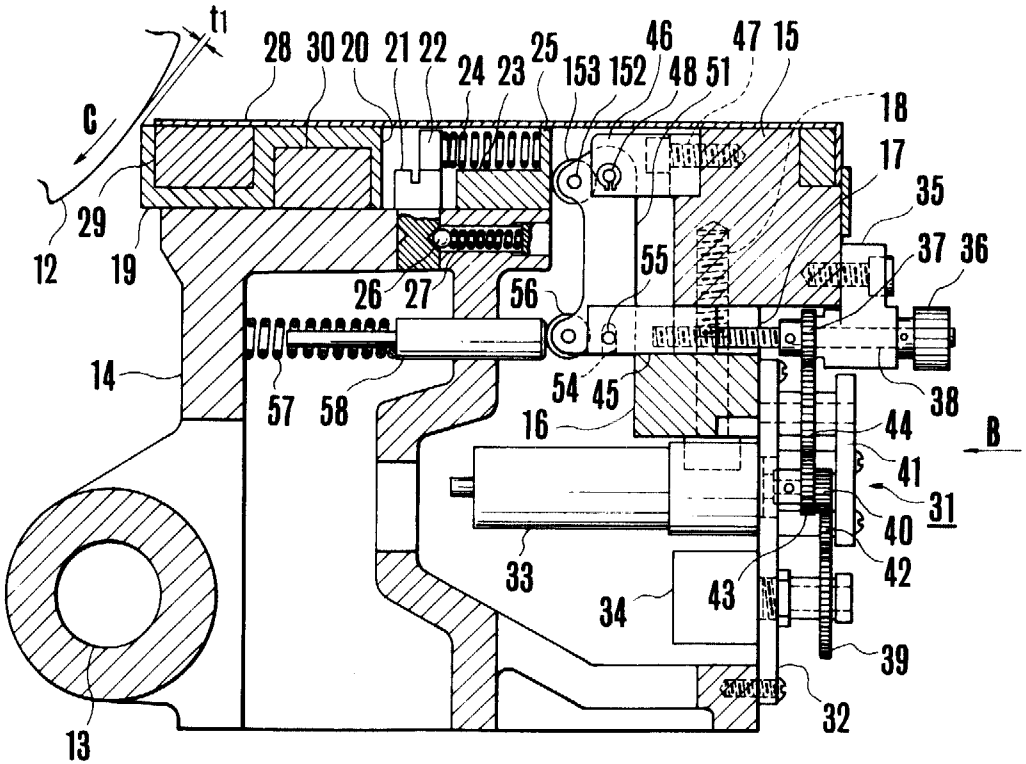
FIGS. 9 through 11 show another embodiment of this invention and corresponding to FIGS. 5, 6 and 8 respectively.
Figure 10:
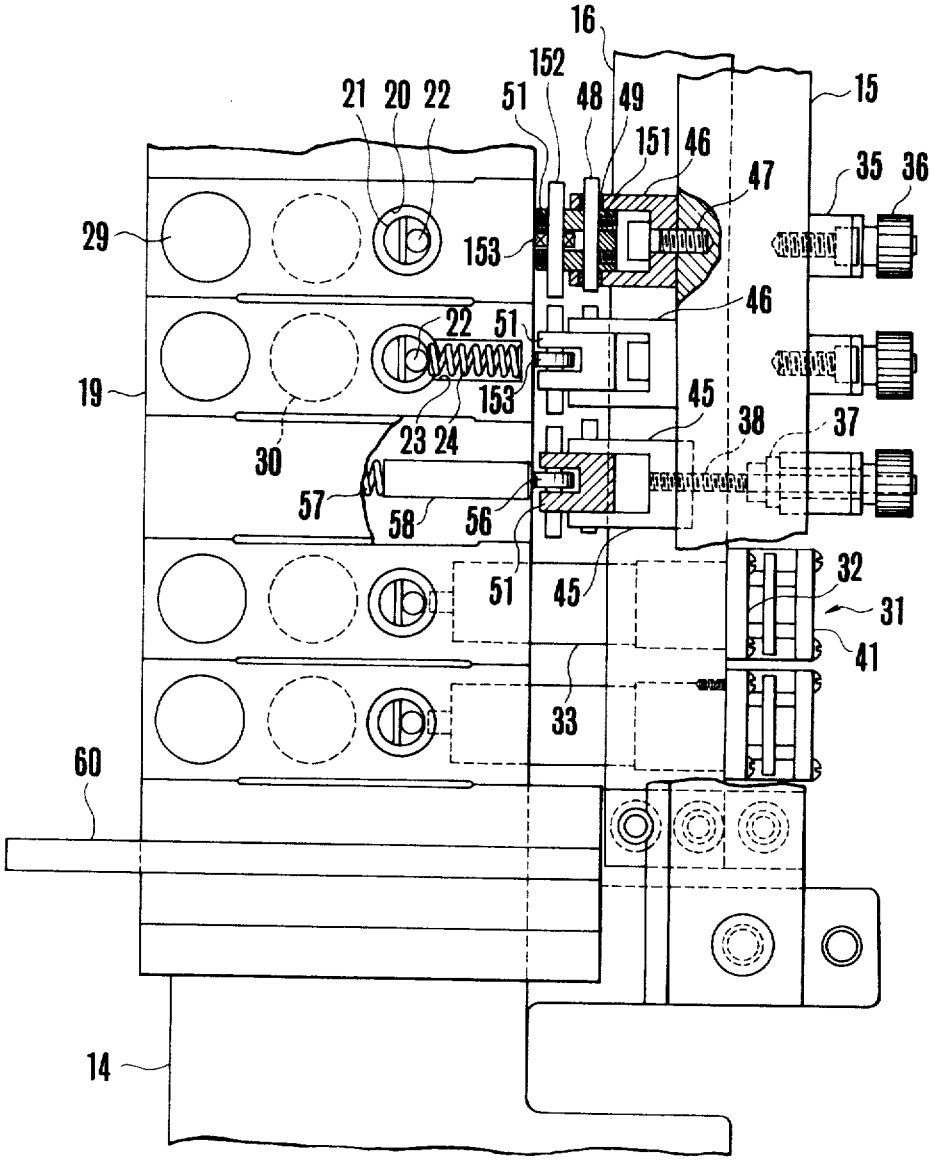
Figure 11:
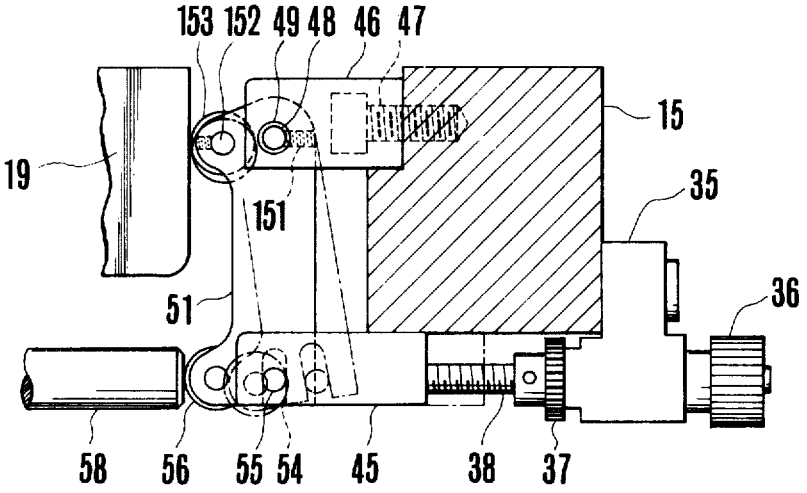

A modified embodiment of this invention shown in FIGS. 9, 10 and 11 is generally similar to the first embodiment shown in FIGS. 4 through 8 except the following points. More particularly, in this modification, a shaft 48 supported by the bracket 46 is not an eccentric pin but merely pivotally connects the adjusting lever 51 to the bracket 46. Thus, the shaft 48 is received in the U shaped upper end of the adjusting lever 51 and fastened by a set screw 151 and a roller supporting pin 152 is secured to an offset portion of the upper end of the adjusting lever 51 to support a roller 153 with its periphery engaged with the rear end of a divided blade 19. As before, the sliding member 45 is connected to the lower end of the adjusting lever 51 through a pin and slot connection 55, 54, and the roller 56 is mounted on the lower end of the lever 51 and engaged by the spring biased pin 58.

Figure 3:
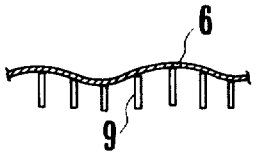
FIG.3 PRIOR ART
Figure 4:
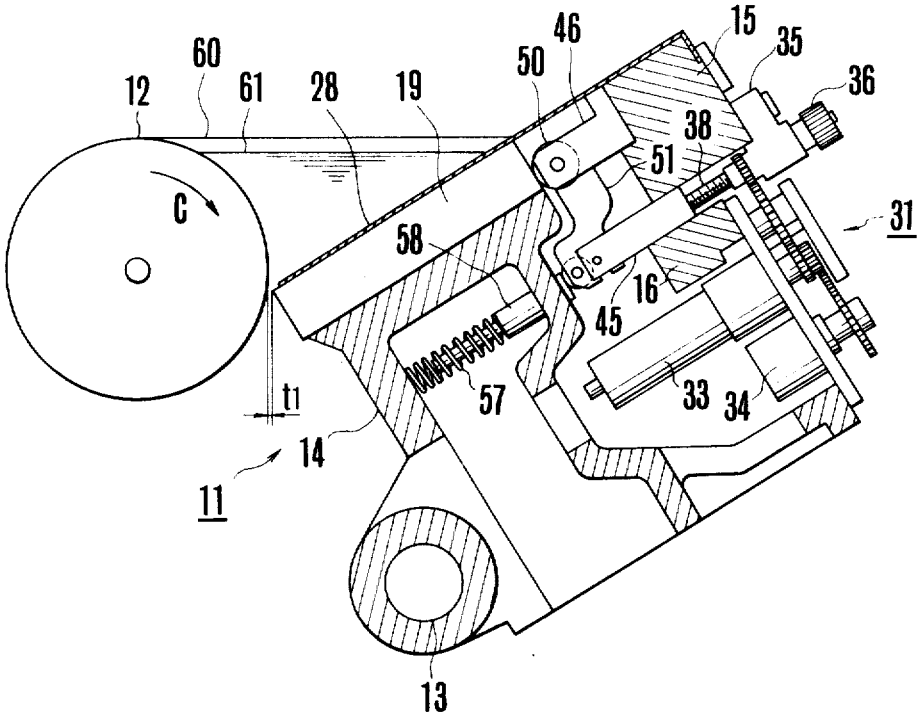
FIG. 4 is a sectional view showing an ink fountain device embodying the invention.
Figure 5:
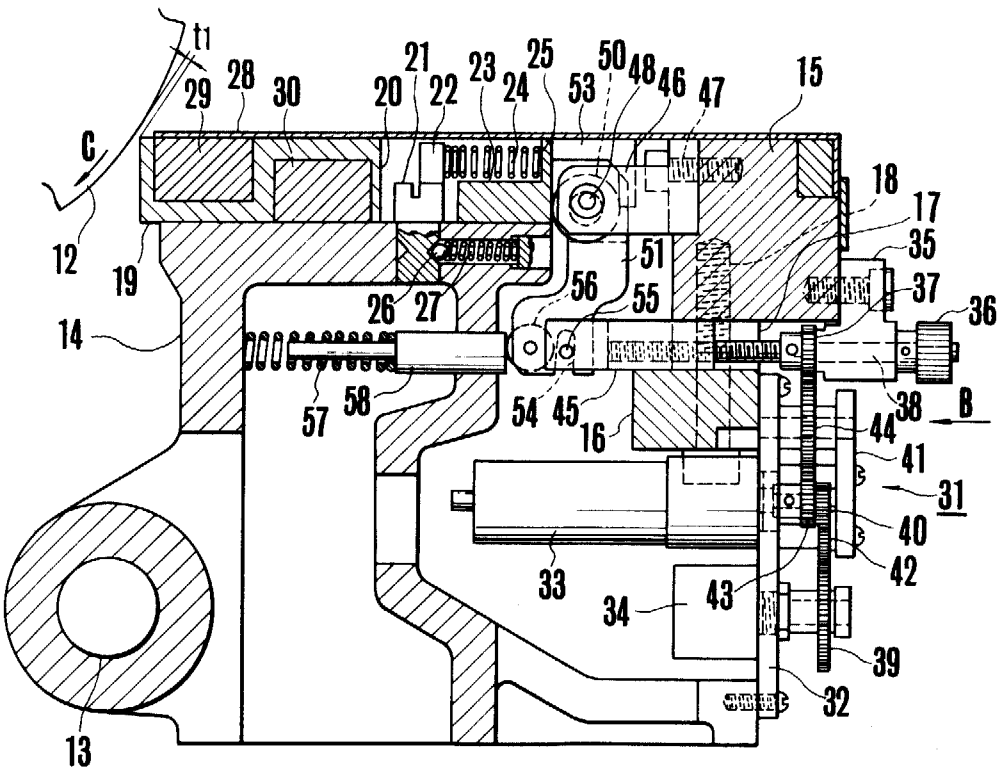
FIG. 5 is an enlarged sectional view of the ink fountain device shown in FIG. 4 showing a detailed construction thereof.
Figure 6:
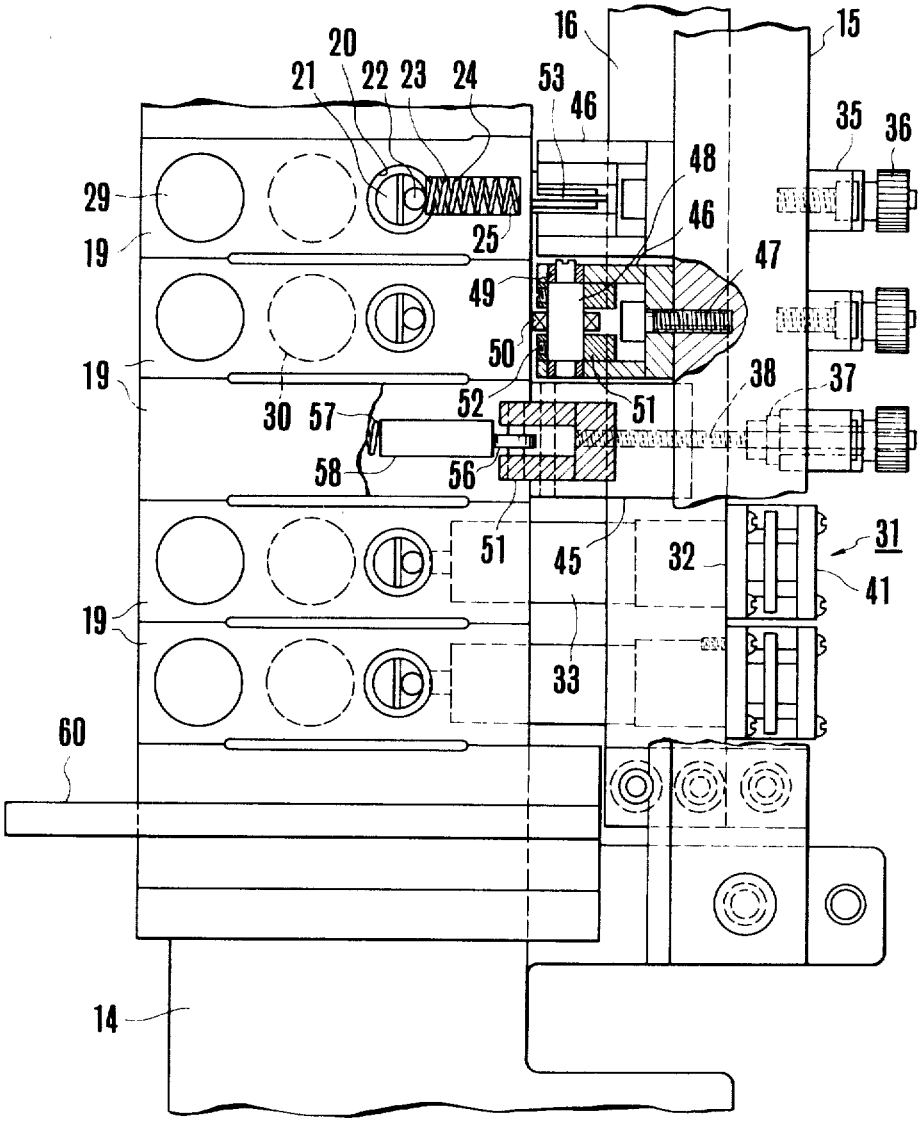
FIG. 6 is a plan view of the device shown in FIG. 5.

It will be noted that this modification operates in the same manner as the first embodiment except that the roller 153 is urged against the rear end of the divided blade 19 instead of the annular roller 50 shown in FIG. 3.

What is claimed is:

1. An ink fountain device for use in a printing press comprising:

an ink fountain roller dipped in an ink pot;

a blade support;

a plurality of divided blades juxtaposed on said blade support to be movable toward and away from a periphery of said ink fountain roller;

first spring means for urging said divided blades to move away from said ink fountain roller towards a plurality of brackets secured to said blade support;

a plurality of adjusting levers respectively pivotably mounted on said brackets;

a plurality of rollers supported by said brackets with their peripheries engaged with rear ends of respective divided blades;

a plurality of sliding members supported by said blade support to reciprocate in the same directions as said divided blades and respectively provided with screw threads;

means for operatively connecting said adjusting levers with respective sliding members;

a plurality of a adjusting screws respectively mating with said screw threaded of said sliding members; and second spring means for urging said sliding members to cause to swing said adjusting levers so as to cause said rollers to move said divided blades toward said ink fountain roller.

2. The ink fountain device according to claim 1 wherein one end of one of said brackets is provided with an eccentric shaft and each one of said plurality of rollers takes the form of an annular ring loosely surrounding said eccentric shaft.

3. The ink fountain device according to claim 1 which further comprises a plurality of eccentric pins, said first spring means being interposed between said eccentric pins and rear ends of said divided blades for urging the same to move away from said ink fountain roller, and means for rotating said eccentric pins.

4. The ink fountain device according to claim 1 wherein each adjusting lever is provided with an eccentric shaft at its upper end, and a slot at its lower end, an annular roller loosely surrounding said eccentric shaft, said slot receiving a pin secured to one sliding member, each sliding member carries a roller at its one end, said last mentioned roller is urged by said second spring means.

5. The ink fountain device according to claim 1 which further comprises electric motors for rotating respective adjusting screws, potentiometers respectively driven by said motors and a control panel including means for controlling said motors and means for displaying signals generated by said potentiometers.

6. The ink fountain device according to claim 1 which further comprises a thin clamping plate covering all of said divided blades and permanent magnet means embedded in respective divided blades for magnetically attracting said clamping plate and said blade support toward said divided blades.

* * * * *